US011637354B2

(12) United States Patent
Balasubramanian et al.

(10) Patent No.: US 11,637,354 B2
(45) Date of Patent: Apr. 25, 2023

(54) METHOD AND SYSTEM OF FABRICATING AND TUNING SURFACE INTEGRATED WAVEGUIDE FILTER

(71) Applicant: John Mezzalingua Associates, LLC, Liverpool, NY (US)

(72) Inventors: Sidharth Balasubramanian, Garland, TX (US); Salah Ud Din Tariq, Allen, TX (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 17/550,178

(22) Filed: Dec. 14, 2021

(65) Prior Publication Data

US 2022/0200114 A1 Jun. 23, 2022

Related U.S. Application Data

(60) Provisional application No. 63/128,568, filed on Dec. 21, 2020.

(51) Int. Cl.

| | |
|---|---|
| ***H01P 11/00*** | (2006.01) |
| ***H01P 1/207*** | (2006.01) |
| ***H01P 1/203*** | (2006.01) |
| ***H01P 3/08*** | (2006.01) |
| ***H01P 1/20*** | (2006.01) |

(52) U.S. Cl.

CPC ..... *H01P 1/207* (2013.01); *H01P 1/2002* (2013.01); *H01P 1/203* (2013.01); *H01P 3/08* (2013.01); *H01P 11/006* (2013.01)

(58) Field of Classification Search

CPC ..... H01P 1/207; H01P 1/203; H01P 1/208; H01P 1/2088; H01P 1/2002; H01P 1/20; H01P 1/201; H01P 3/08; H01P 3/12; H01P 3/122; H01P 3/121; H01P 3/16; H01P 3/00; H01P 11/006; H01P 11/001

See application file for complete search history.

(56) References Cited

U.S. PATENT DOCUMENTS

| | | | | |
|---|---|---|---|---|
| 11,063,329 | B1 * | 7/2021 | Rmili | H01P 1/182 |
| 11,196,140 | B2 * | 12/2021 | Uemichi | H01P 1/2138 |
| 11,362,405 | B2 * | 6/2022 | Kidera | H01P 1/2088 |

* cited by examiner

*Primary Examiner* — Stephen E. Jones
(74) *Attorney, Agent, or Firm* — Michael A. Rahman

(57) ABSTRACT

A method of fabricating and tuning a surface integrated waveguide (SIW) filter incudes covering upper and lower surfaces of a dielectric substrate with a metallic layer. The method includes drilling a plurality of vias on the dielectric substrate and covering the vias with the metallic layer, wherein a first group of vias forms one or more cavity resonators, a second group of vias defines coupling channels between the cavity resonators, a third group of vias defines an effective width and a fourth group of vias defines an effective length of the cavity resonators. The method includes varying a center frequency by increasing diameters of the second group of vias to decrease the width of the coupling channels and varying a roll-off by increasing diameters of the third and fourth groups of vias to decrease the effective width and the effective length of the resonators.

13 Claims, 6 Drawing Sheets

METHOD AND SYSTEM OF FABRICATING AND TUNING SURFACE INTEGRATED WAVEGUIDE FILTER

CROSS REFERENCE TO RELATED APPLICATION

This application claims priority from U.S. Provisional Application No. 63/128,568, filed Dec. 21, 2020, entitled "Method and System of Fabricating and Tuning Surface Integrated Waveguide Filter", assigned to the present assignee and incorporated herein by reference.

BACKGROUND

The disclosure generally relates to wireless communications technologies, and in particular to a method and system of fabricating and tuning a surface integrated waveguide (SIW) filter.

DESCRIPTION OF THE RELATED ART

Substrate Integrated Waveguides (SIWs) are constructed to guide electromagnetic waves by using rows of metallic vias or holes which operate like a metallic wall. SIWs are used in wireless communications such as microwave and millimeter wave systems because they offer improved immunity against radiation losses and low insertion losses.

A SIW is fabricated on a thin dielectric substrate covered on upper and lower surfaces by a metallic layer. Rows of metallic vias or holes are drilled into the dielectric substrate and the vias are covered with the metallic layer to electrically connect upper and lower conductive layers of the SIW filter. The embedded vias limit the wave propagation area and guide electromagnetic waves like a metallic wall.

A SIW can be constructed as a filter such as, for example, a bandpass filter, a low pass filter, a high pass filter or a band stop filter. To construct a bandpass filter, the rows of vias are organized to form cavity resonators. The geometric parameters such as effective width, length and coupling of the cavity resonators determine the frequency response of the bandpass filter. Due to the low resistance of the metallic wall formed by the vias, the range of frequencies around the resonant frequency at which the cavity resonators resonate is very narrow. Hence, the SIW filter can act as narrow bandpass filters. The resonant frequency of the filter can be tuned by moving the walls of the cavity resonators in or out, changing its size.

SUMMARY

In one aspect, a method of fabricating and tuning a surface integrated waveguide (SIW) filter includes covering upper and lower surfaces of a dielectric substrate with a metallic layer to form upper and lower conductive layers and forming input and output ports. The method also includes drilling a plurality of vias on the dielectric substrate in a predetermined geometric organization, and covering the vias with the metallic layer to provide conduction paths between the upper and lower conductive layers, wherein a first group of vias forms one or more cavity resonators, a second group of vias defines coupling channels between the cavity resonators, a third group of vias defines an effective width and a fourth group of vias defines an effective length of the cavity resonators. The cavity resonators are electromagnetically coupled through the coupling channels and couple the input and output ports. The method also includes applying an input signal having selected frequencies at the input port and propagating the input signal through the SIW filter and providing an output signal at the output port and evaluating the output signal to determine if the center frequency of the output signal is less than a threshold center frequency. If the center frequency is less than the threshold center frequency, the method includes continuing to increase diameters of the second group of vias incrementally to decrease the width of the coupling channels and evaluating the output signal for each incremental decrease of the width of the coupling channels until the center frequency is greater than or equal to the threshold center frequency. If the center frequency is greater than or equal to the threshold center frequency, the method includes evaluating the output signal to determine if a roll-off is less than a threshold roll-off. If the roll-off is less than the threshold roll-off, the method includes continuing to increase the diameters of the third and fourth groups of vias incrementally to decrease the effective width and the effective length of the cavity resonators and evaluating the output signal for each incremental decrease of the effective width and the effective length until the roll-off is greater than or equal to the threshold roll-off.

In an additional aspect, increasing the diameters of the vias comprises drilling the vias to increase the diameter and covering the inner surfaces of the vias with the metallic layer to provide conduction paths between the upper and lower conductive layers.

In an additional aspect, a SIW filter includes a dielectric substrate having a metallic layer covering its upper and lower surfaces forming upper and lower conductive layers and forming input and output ports. The SIW filter also includes a plurality of vias embedded on the dielectric substrate in a predetermined geometric organization and locations, wherein the walls of the vias are covered with the metallic layer to provide conduction paths between the upper and lower conductive layers. The SIW filter also includes one or more cavity resonators formed by a first group of vias, wherein the cavity resonators are electromagnetically coupled by coupling channels defined by a second group of vias, and wherein a third group of vias defines an effective width and a fourth group of vias defines an effective length of the cavity resonators, wherein a bandwidth and a center frequency of the SIW filter are determined by locations, geometric organization and diameters of the second group of vias defining the coupling channels, and wherein a roll-off is determined by locations, the geometric organization, and diameters of the third and fourth group of vias.

In an additional aspect, the vias are geometrically organized to limit wave propagation area in the dielectric substrate and guide electromagnetic waves from the input port to the output port.

In an additional aspect, a method of fabricating and tuning a SIW filter includes covering upper and lower surfaces of a dielectric substrate with a metallic layer forming upper and lower conductive layers and forming input and output ports. The method includes drilling a plurality of vias on the dielectric substrate in a predetermined geometric organization, and covering inner surfaces of the vias with the metallic layer to provide conduction paths between the upper and lower conductive layers, wherein a first group of vias forms one or more cavity resonators, a second group of vias defines coupling channels between the cavity resonators, a third group of vias defines an effective width and a fourth group of vias defines an effective length of the cavity resonators, and wherein the cavity resonators are electromagnetically coupled through the coupling channels and couple the input and output ports. The method includes varying a center frequency by increasing diameters of the second group of vias to decrease the width of the coupling channels and varying a roll-off by increasing the diameters of the third and fourth groups of vias to decrease the effective width and the effective length of the resonators.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Rather, these descriptions are provided so that this disclosure will satisfy applicable requirements.

Figure 1A:
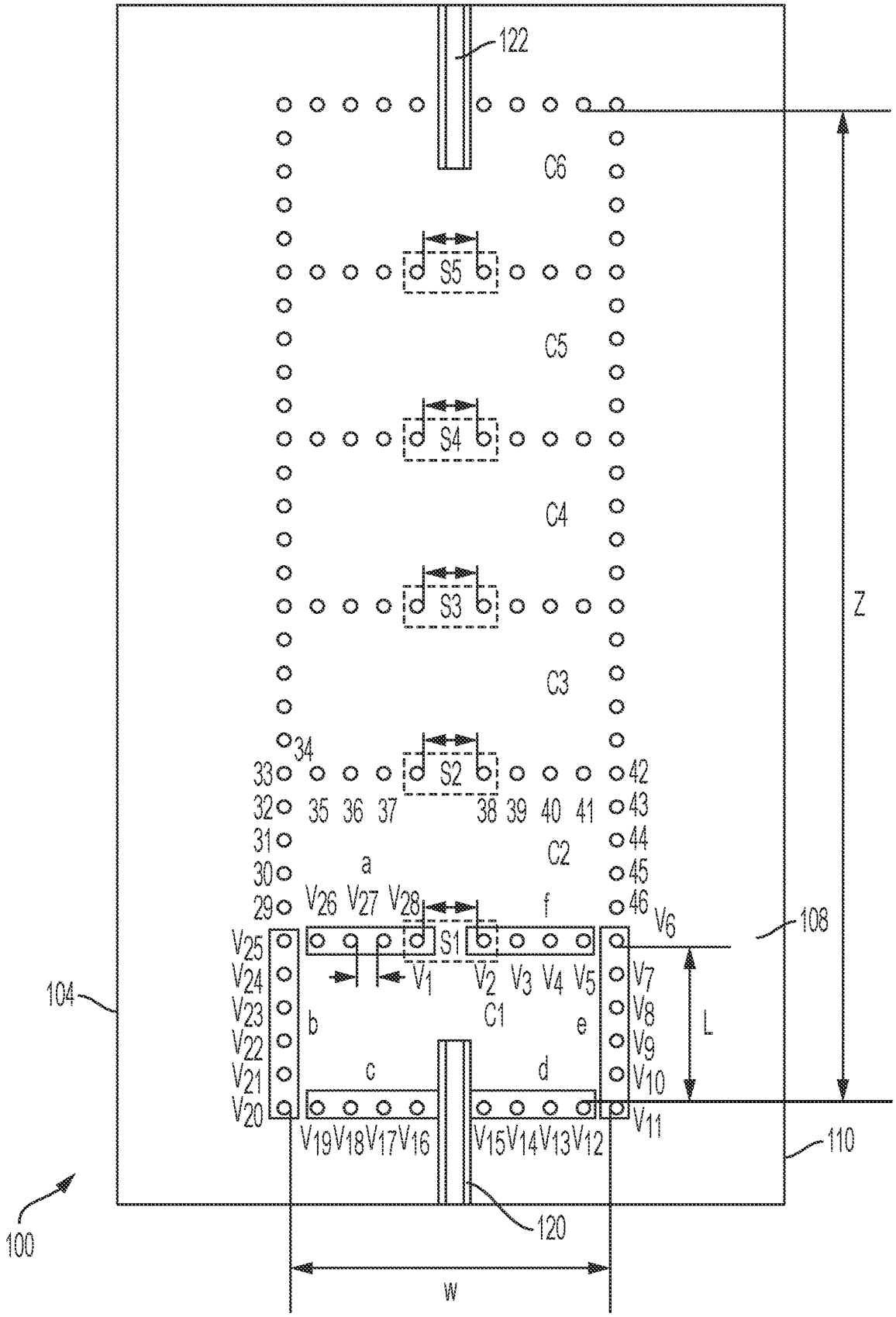
FIGS. 1A and 1B illustrate top and cross-sectional views, respectively, of a surface integrated waveguide (SIW) filter in accordance with an example embodiment of the disclosure.
Figure 1B:
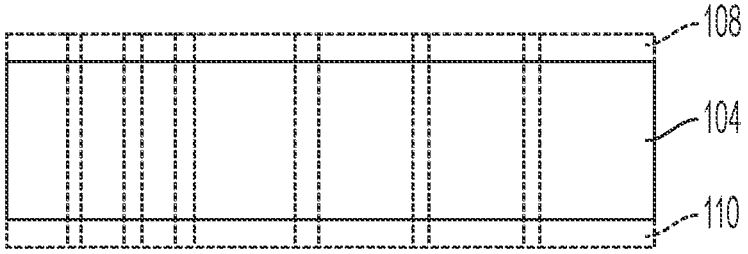

FIGS. 1A and 1B illustrate top and cross-sectional views, respectively, of a surface integrated waveguide (SIW) filter 100 in accordance with an example embodiment of the disclosure. The SIW filter 100 is constructed to operate as a bandpass filter, however, other embodiments can be constructed to operate as a low pass filter, a high pass filter, or a bandstop filter. The SIW filter 100 has advantageous properties in that it can be tuned during fabrication to provide a desired passband, a roll-off, and acceptable insertion losses.

The expression "substrate integrated waveguide" or SIW will be used throughout the present description but also encompasses laminated waveguides, post waveguides and other synonymous expressions used in the art for representing this type of waveguides.

With continuing reference to FIGS. 1A and 1B, the SIW filter 100 comprises a thin dielectric substrate 104 which is fabricated from an electrically insulating material. The utilization of such a thin substrate 104 enables the production of printed circuit boards.

With continuing reference to FIGS. 1A and 1B, the upper and lower surfaces of the dielectric substrate 104 are covered with a conductive layer, preferably a conductive metal, such as copper, gold or silver. By covering the upper and lower surfaces with the conductive layer, upper and lower conductive layers 108 and 110 are formed.

A plurality of vias $V_1$-$V_N$ (i.e., holes) are drilled through the dielectric substrate 104. The vias $V_1$-$V_N$ extend from the upper conductive layer 108 to the lower conductive layer 110. The vias $V_1$-$V_N$ are embedded in the dielectric substrate 104 in a predetermined geometric organization and positions which are selected based on such parameters as bandpass characteristics, roll-off and acceptable insertion losses. The inner surfaces (inner walls) of the vias $V_1$-$V_N$ are covered with a conductive layer to provide conduction paths between the upper and lower conductive layers 108 and 110.

With continuing reference to FIG. 1A, the vias $V_1$-$V_N$ are embedded to form one or more cavity resonators $C_1$-$C_6$ in the dielectric substrate 104. Depending on their geometric parameters and positions, the cavity resonators $C_1$-$C_6$ exhibit resonance at selected frequencies, and block frequencies in a selected range but allow selected frequencies to pass through the SIW filter 100.

With continuing reference to FIG. 1A, the first group of vias $V_1$-$V_{28}$ forms the first cavity resonator $C_1$. The first and second cavity resonators $C_1$ and $C_2$ are electromagnetically coupled by a coupling channel $S_1$ defined by the vias $V_1$ and $V_2$. Similarly, the second and third cavity resonators $C_2$ and $C_3$ are electromagnetically coupled by a coupling channel $S_2$.

With continuing reference to FIG. 1A, selected portions of the metallic layer covering the upper conductive layer 108 are removed from input and output ports 120 and 122. Various known techniques in the art such as wet etching, plasma etching, dry etching, dissolution in solvents and ultrasound may be used to remove portions of the metallic layer. The input port 120 is formed such that it is partially within the first cavity resonator $C_1$. As a result, an input signal applied at the input port 120 is directly applied to the first cavity resonator $C_1$. The output port 122 is formed so it is partially within the last cavity resonator $C_6$. The cavity resonators electromagnetically couple the input and output ports 120 and 122. When an input signal is applied to the input port 120, the input signal propagates through the dielectric substrate 104. The vias $V_1$-$V_N$ embedded in the dielectric substrate 104 act like metallic walls which limit the propagation area of the signal and guide the signal through the cavity resonators $C_1$-$C_6$. As the signal propagates through the dielectric substrate 104, the cavity resonators $C_1$-$C_6$ act as filters, blocking selected frequencies and allowing other frequencies to pass through. The filtered output signal is provided at the output port 122.

With continuing reference to FIG. 1A, because the SIW filter 100 comprises six rectangular cavity resonators $C_1$-$C_6$, the SIW filter 100 is known as a $6^{th}$ order SIW filter. The cavity resonators $C_1$-$C_6$ are sized to resonate at the center frequency of the bandpass filter.

With continuing reference to FIG. 1A, the electromagnetic coupling between two adjacent cavity resonators are defined by the width of the coupling channel. Referring to FIG. 1A, the vias $V_1$ and $V_2$ define a coupling channel of a width $S_1$ between the cavity resonators $C_1$ and $C_2$. The vias $V_{37}$ and $V_{38}$ define a coupling channel of a width $S_2$ between the cavity resonators $C_2$ and $C_3$. An increase of the width $S_1$ increases the electromagnetic coupling between the two adjacent cavity resonators $C_1$ and $C_2$ and a decrease of the width $S_1$ decreases the electromagnetic coupling between the adjacent cavity resonators $C_1$ and $C_2$. Likewise, an increase of the width $S_2$ increases the electromagnetic coupling between the two adjacent cavity resonators $C_2$ and $C_3$ and a decrease of the width $S_2$ decreases the electromagnetic coupling between the adjacent cavity resonators $C_2$ and $C_3$. The electromagnetic coupling between the cavity resonators $C_3$ and $C_4$, between $C_4$ and $C_5$, and between $C_5$ and $C_6$ can be adjusted similarly. If the electromagnetic coupling between two or more adjacent cavity resonators is increased, the bandwidth of the SIW filter 100 is increased, and conversely if the electromagnetic coupling between two or more adjacent cavity resonators is reduced, the bandwidth of the SIW filter 100 is reduced. In one embodiment, electromagnetic coupling between only two cavity resonators may be adjusted, and in other embodiments, electromagnetic coupling between three or more cavity resonators may be adjusted. By reducing the width of one or more coupling channels, the bandwidth of the SIW 100 filter can be reduced.

In an example embodiment of the disclosure, the coupling channel width $S_1$ is reduced by increasing the diameters of the vias defining the coupling channel. As the diameters of the vias $V_1$ and $V_2$ are increased, $S_1$ is reduced, which reduces the bandwidth of the SIW filter 100. Likewise, the coupling channel width $S_2$ is reduced by increasing the diameters of the vias $V_{37}$ and $V_{38}$. The coupling channel width of the other coupling channels can be reduced similarly.

With continuing reference to FIG. 1A, an effective width W of the cavity resonator $C_1$ is defined by the distance between the vias $V_{11}$ and $V_{20}$ or by the distance between the vias $V_6$ and $V_{25}$. The effective length L of the cavity resonator C1 is defined by the distance between the vias $V_6$ and $V_{11}$ or by the distance between the vias $V_{20}$ and $V_{25}$. The effective width W of the cavity resonator $C_2$ is defined by the distance between the vias $V_{42}$ and $V_{33}$ or by the distance between the vias $V_{25}$ and $V_6$. The effective length L of the cavity resonator $C_2$ is defined by the distance between the vias $V_6$ and $V_{42}$ or by the distance between the vias $V_{25}$ and $V_{33}$. The effective width and length of the other cavity resonators are similarly defined. The effective width W controls the lower cut-off frequency of the bandpass filter and the effective length L controls the resonant frequency of the bandpass filter. If W is reduced, the lower cut-off frequency shifts higher, and if L is reduced, the center frequency shifts higher. By selecting appropriate values of W and L, the lower cut-off frequency and the center frequency of the SIW filter 100 are set. As a result, the resonant frequency of the filter can be tuned by moving the walls of the cavity resonators in, reducing its size.

In an example embodiment of the disclosure, the effective width W of the cavity resonators are reduced by increasing the diameters of the vias defining the effective width, and the effective length L of the cavity resonators are reduced by increasing the diameters of the vias defining the effective length. By increasing the diameters of the vias defining the effective width and length of the cavity resonators, the center frequency and the lower cut-off frequency are shifted higher, thereby moving the resonant frequency higher.

Figure 2:
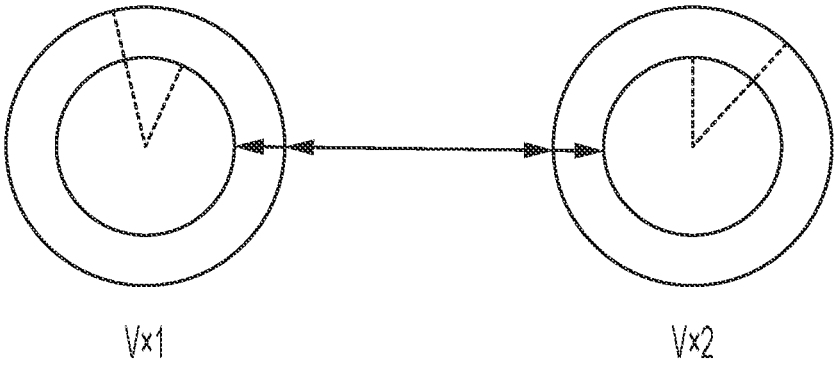
FIG. 2 illustrates a process of reducing a channel width by increasing diameters of vias.

FIG. 2 illustrates two vias $V_{X1}$ and $V_{X2}$ which define a coupling channel between two cavity resonators. Initially, the vias $V_{X1}$ and $V_{X2}$ are drilled each having a diameter 8 mm. To shift the bandpass frequencies higher, the vias $V_{X1}$ an $V_{X2}$ are drilled wider, increasing the diameter from 8 mm to 10 mm. As a result, the coupling channel width is reduced, which has the effect of moving the passband frequencies higher.

Figure 3:
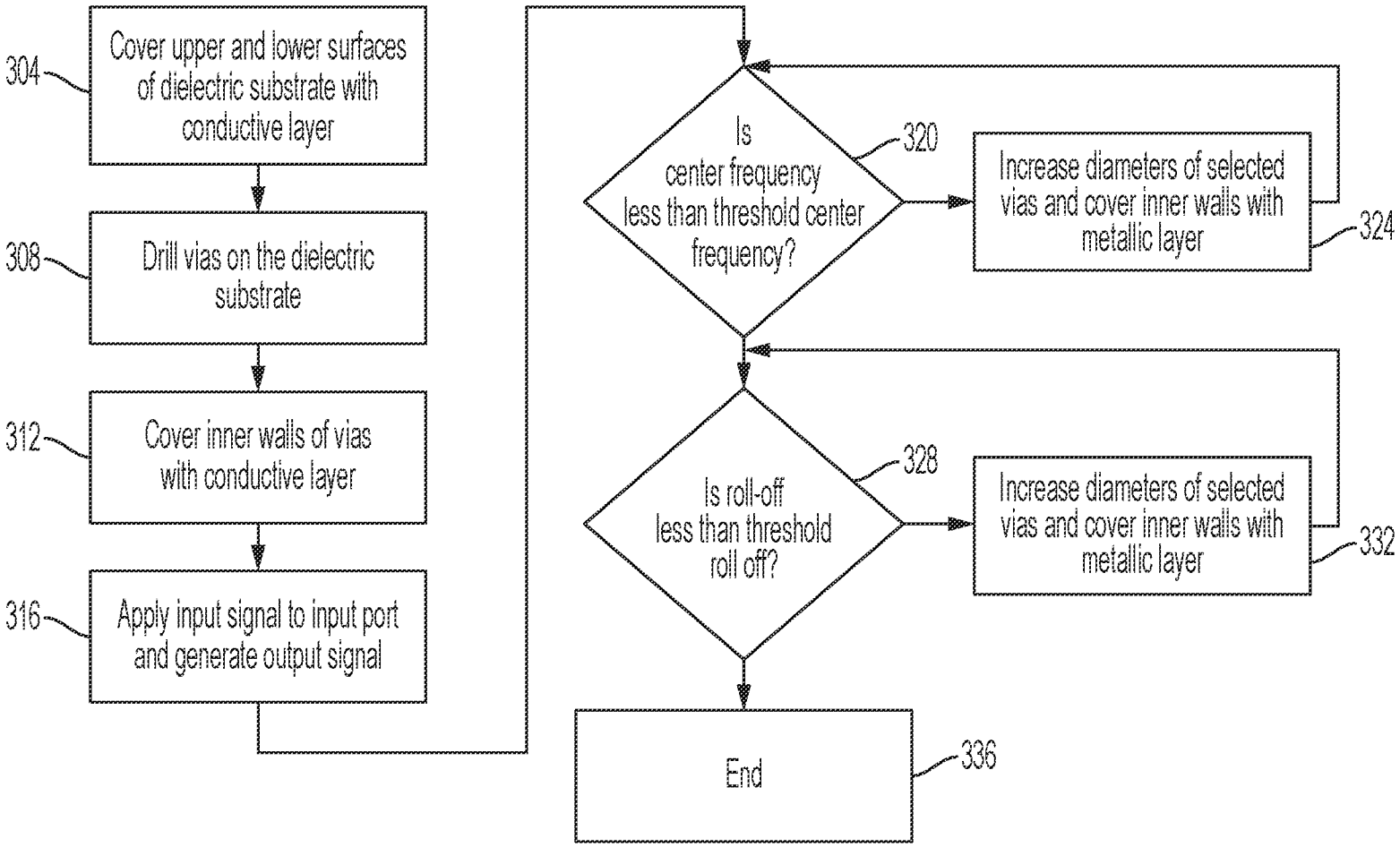
FIG. 3 is a flow diagram of a method of fabricating and tuning a SIW filter in accordance with an example embodiment.

FIG. 3 is a flow diagram of a method of fabricating and tuning a SIW filter in accordance with an example embodiment. In a block 304, upper and lower surfaces of a thin dielectric substrate are covered with a conductive layer and input and output ports are formed. In a block 308, a plurality of vias are drilled on the dielectric substrate in a predetermined geometric organization, and in a block 312, inner walls of the vias are covered with the conductive layer to provide conduction paths between upper and lower conductive layers. The vias are embedded in a predetermined organization such that a first group of vias form one or more cavity resonators, a second group of vias define coupling channels between the cavity resonators, a third group of vias define an effective width and a fourth group of vias define an effective length of the cavity resonators.

Figure 4:
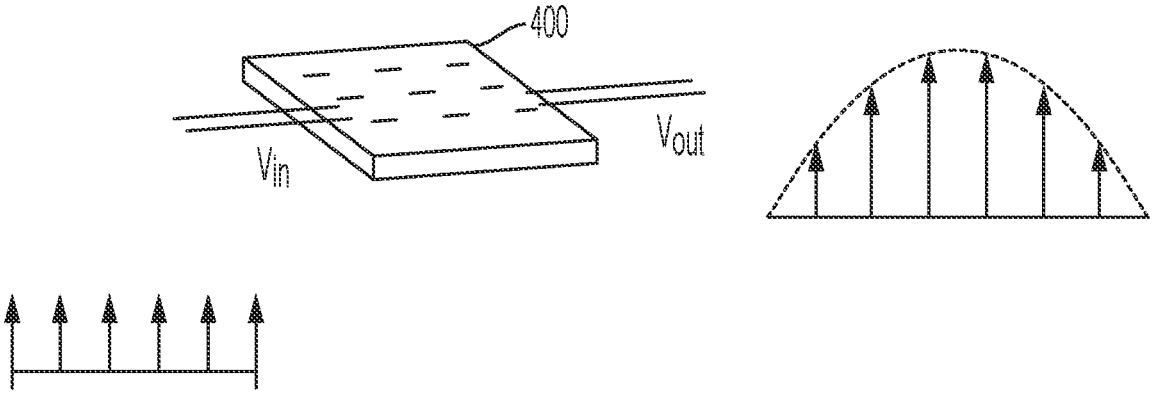
FIG. 4 shows an input signal applied to a SIW filter and a resulting output signal.

In a block 316, an input signal comprising a plurality of frequencies (i.e., tones) is applied to the input port. The plurality of frequencies can be applied concurrently all together as a band-limited signal signal (or a chirp) or they can be applied one by one for each frequency point. The input signal Vin propagates through the dielectric substrate of the SIW filter. The vias which are embedded in the dielectric substrate act like metallic walls, which limit the propagation area of the signal and guide the signal through the cavity resonators. As the input signal Vin propagates through the dielectric substrate, the cavity resonators act filters, blocking selected frequencies and allowing other frequencies to pass. The filtered signal is provided as an output signal Vout at the output port. FIG. 4 shows an input signal Vin having a plurality of frequencies applied to the SIW filter 400 and a resulting output signal Vout having the same plurality of frequencies, such that each one of those plurality of frequencies is conditioned in terms of amplitude and phase.

In a block 320, the plurality of frequencies in the output signal is evaluated by comparing with the frequencies in the input signal to determine filter parameters such as center frequency, insertion loss, roll-off characteristics, stop band suppression, etc. The frequencies may be evaluated using measurement instruments, such as a network analyzer, a spectrum analyzer, or an oscilloscope.

Figure 5:
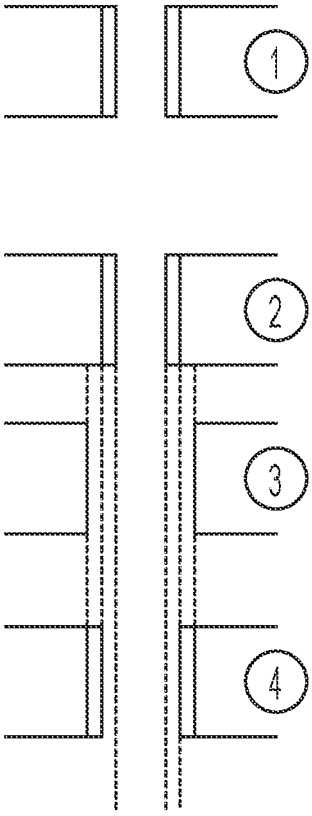
FIG. 5 illustrates a process of incrementally increasing the diameter of a via.
Figure 6:
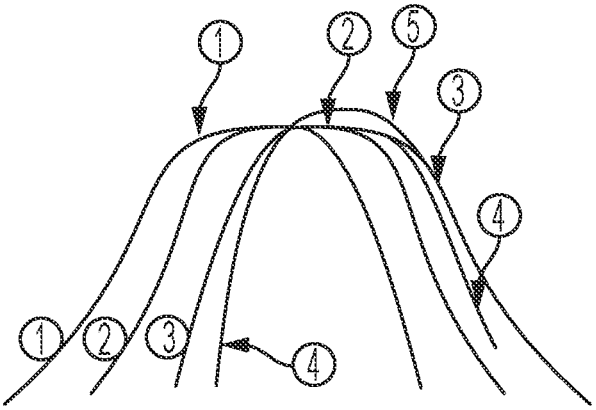
FIG. 6 shows effects as the diameter is incrementally increased.

For example, the center frequency of the output signal Vout can be 37 GHz and a threshold center frequency (or target center frequency) can be 39 GHz. If the center frequency of the SIW filter is less than the threshold center frequency, in a block 324 the diameters of a first selected group of vias are increased and the inner surfaces of the vias are covered with the metallic layer. For example, the diameters of the selected group of vias can be increased from 8 mm to 10 mm. The output signal is then evaluated to determine if the center frequency is less than the threshold frequency. The foregoing process is repeated by incrementally increasing the diameters of the selected group of vias to decrease the width of the coupling channels and evaluating the output signal for each incremental decrease of the width of the coupling channels until the center frequency is greater or equal to the threshold center frequency. FIG. 5 illustrates the process in steps 1-4 of incrementally increasing a diameter of a via. FIG. 6 shows a center frequency of the passband shifting higher as the diameter of the via is incrementally increased in steps 1-4.

With reference to FIG. 3, if the center frequency of the SIW filter 100 is greater or equal to the threshold center frequency, the flow moves to a block 328 in which the output signal Vout is evaluated to determine if the roll-off of the SIW filter is less than a threshold roll-off (or target roll-off). For example, the measured roll-off may be 30 dB/dec but the threshold roll-off may be 40 dB/dec. If the roll-off is less than the threshold roll-off, the flow moves to a block 332 in which the diameters of a second selected group of vias are increased to reduce the effective width W and the effective length of the cavity resonators and the output signal is evaluated, and the process is repeated for each incremental decrease of the effective width and the effective length until the roll-off is greater or equal to the threshold roll-off frequency. The flow ends in a block 336.

Various illustrative components, blocks, modules, and steps have been described above in general terms of their functionality. The described functionality may be implemented in varying ways for each particular application, but such implementation decision should not be interpreted as causing a departure from the scope of the present disclosure.

For simplicity and clarity, the full structure and operation of all systems suitable for use with the present disclosure is not being depicted or described herein. Instead, only so much of a system as is unique to the present disclosure or necessary for an understanding of the present disclosure is depicted and described.

What is claimed is:

1. A method of fabricating a surface integrated waveguide (SIW) filter, comprising:

covering upper and lower surfaces of a dielectric substrate with a metallic layer to form upper and lower conductive layers and forming input and output ports;

drilling a plurality of vias on the dielectric substrate in a predetermined geometric organization, and covering inner surfaces of the vias with the metallic layer to provide conduction paths between the upper and lower conductive layers, wherein a first group of vias forms one or more cavity resonators, a second group of vias defines coupling channels between the cavity resonators, a third group of vias defines an effective width and a fourth group of vias defines an effective length of the cavity resonators, and wherein the cavity resonators are electromagnetically coupled through the coupling channels and couple the input and output ports;

applying an input signal having selected frequencies at the input port and propagating the input signal through the SIW filter and providing an output signal at the output port;

determining if the center frequency of the output signal is less than a threshold center frequency;

if the center frequency is less than the threshold center frequency, continuing to increase diameters of the second group of vias incrementally to decrease the width of the coupling channels and evaluating the output signal for each incremental decrease of the width of the coupling channels until the center frequency is greater than or equal to the threshold center frequency;

if the center frequency is greater than or equal to the threshold center frequency, evaluating the output signal to determine if a roll-off is less than a threshold roll-off; and if the roll-off is less than the threshold roll-off, continuing to increase diameters of the third and fourth groups of vias incrementally to decrease the effective width and the effective length of the cavity resonators and evaluating the output signal for each incremental decrease of the effective width and the effective length until the roll-off is greater than or equal to the threshold roll-off.

2. The method of claim 1, wherein increasing the diameters of the vias comprises drilling the vias to increase the diameters and covering the inner surfaces of the vias with the metallic layer to provide conduction paths between the upper and lower conductive layers.

3. The method of claim 1, wherein increasing the diameters of the second group of vias reduces the bandwidth of the SIW filter.

4. The method of claim 1, wherein decreasing the width of the coupling channels reduces the bandwidth of the SIW filter.

5. A method of fabricating and tuning a surface integrated waveguide (SIW) filter, comprising:

covering upper and lower surfaces of a dielectric substrate with metallic layers forming upper and lower conductive layers and forming input and output ports;

drilling a plurality of vias on the dielectric substrate in a predetermined geometric organization, wherein a first group of vias forms one or more cavity resonators, a second group of vias defines coupling channels between the cavity resonators, a third group of vias defines an effective width and a fourth group of vias defines an effective length of the cavity resonators, and wherein the cavity resonators are electromagnetically coupled through the coupling channels and couple the input and output ports;

varying a center frequency by increasing diameters of the second group of vias to decrease the width of the coupling channels; and varying a roll-off by increasing diameters of the third and fourth groups of vias to decrease the effective width and the effective length of the resonators.

6. The method of claim 5, further comprising:

applying an input signal having selected frequencies at the input port and propagating the input signal through the SIW filter and providing an output signal at the output port;

evaluating the output signal to determine if the center frequency is less than a threshold center frequency;

if the center frequency is less than the threshold center frequency, increasing diameters of the second group of vias to decrease the width of the coupling channels.

7. The method of claim 5, further comprising:

evaluating an output signal to determine if the roll-off is less than a threshold roll-off; and increasing the diameters of the third and fourth groups of vias incrementally to decrease the effective width and the effective length of the resonators.

8. The method of claim 5, wherein increasing the diameters of the vias comprises drilling the vias to increase the diameters and covering the inner surfaces of the vias with the metallic layers to provide conduction paths between the upper and lower conductive layers.

9. The method of claim 5, wherein increasing the diameters of the second group of vias reduces the bandwidth of the SIW filter.

10. The method of claim 5, wherein decreasing the width of the coupling channels reduces the bandwidth of the SIW filter.

11. The method of claim 5, further comprising covering inner surfaces of the vias with the metallic layer to provide conduction paths between the upper and lower conductive layers.

12. A method of fabricating and tuning a surface integrated waveguide (SIW) filter, comprising:

covering upper and lower surfaces of a dielectric substrate with metallic layers forming upper and lower conductive layers and forming input and output ports;

drilling a plurality of vias on the dielectric substrate in a predetermined geometric organization, wherein a first group of vias forms one or more cavity resonators, a second group of vias defines coupling channels between the cavity resonators, a third group of vias defines an effective width and a fourth group of vias defines an effective length of the cavity resonators;

decreasing a center frequency of the SIW filter by increasing diameters of the second group of vias; and varying a roll-off by increasing diameters of the third and fourth groups of vias.

13. The method of claim 12, further comprising covering inner surfaces of the vias with the metallic layer to provide conduction paths between the upper and lower conductive layers.

* * * * *